US006540650B1

(12) United States Patent
Krull

(10) Patent No.: US 6,540,650 B1
(45) Date of Patent: Apr. 1, 2003

(54) WEIGHT SELECTION METHOD AND APPARATUS

(76) Inventor: Mark A. Krull, 1705 E. Ridge Ct., Northfield, MN (US) 55057

( * ) Notice: Subject to any disclaimer, the term of this patent is extended or adjusted under 35 U.S.C. 154(b) by 0 days.

(21) Appl. No.: 09/575,785

(22) Filed: May 22, 2000

Related U.S. Application Data

(60) Provisional application No. 60/136,095, filed on May 26, 1999.

(51) Int. Cl.[7] ..... A63B 21/072
(52) U.S. Cl. ..... 482/107; 482/94; 482/108
(58) Field of Search ..... 482/93, 94, 98, 482/908, 106–109

(56) References Cited

U.S. PATENT DOCUMENTS 3,612,523 A * 10/1971 Glynn ..... 482/98
4,610,449 A * 9/1986 Diercks, Jr. ..... 482/98
5,123,885 A * 6/1992 Shields ..... 482/107
5,284,463 A * 2/1994 Shields ..... 482/107
5,556,362 A * 9/1996 Whipps ..... 482/98
5,876,313 A * 3/1999 Krull ..... 482/98
6,083,144 A * 7/2000 Towley et al. ..... 482/107
6,224,519 B1 * 5/2001 Doolittle ..... 482/98

* cited by examiner

*Primary Examiner*—Jerome W. Donnelly
*Assistant Examiner*—Victor Hwang

(57) ABSTRACT

Weights are selectively engaged by a weight selector assembly for movement during exercise activity. The weights are engaged by a selector member which is operable only when the weight selector assembly is docked relative to a weight supporting base.

39 Claims, 6 Drawing Sheets

WEIGHT SELECTION METHOD AND APPARATUS

CROSS-REFERENCE TO RELATED APPLICATION

Disclosed herein is subject matter that is entitled to the filing date of U.S. Provisional Application No. 60/136,095, filed on May 26, 1999.

FIELD OF THE INVENTION

The present invention relates to weight selection methods and apparatus which are suitable for use on various types of exercise equipment, including free weight barbells and dumbbells.

BACKGROUND OF THE INVENTION

Certain exercise apparatus and/or methods have been developed to facilitate relatively more convenient weight adjustments. Relatively recent developments in the dumbbell category, for example, have made it easier to add or remove weight plates relative to a handle assembly. Examples of such improvements are disclosed in U.S. Pat. Nos. 5,839,997 and 6,033,350. An object of the present invention is to improve these sorts of methods and apparatus by reducing the possibility of the weight plates becoming disengaged during exercise activity.

SUMMARY OF THE INVENTION

The present invention provides locking arrangements to prevent inadvertent or ill-advised weight selection operations whenever a weight carrying member is removed from a base which supports any "unselected" weight plates. Many of the features and/or advantage of the present invention will become apparent from the more detailed description that follows.

BRIEF DESCRIPTION OF THE DRAWINGS

With reference to the Figures of the Drawing, wherein like numerals represent like parts and assemblies throughout the several views.

DETAILED DESCRIPTION OF THE PREFERRED EMBODIMENT

The present invention provides methods and apparatus which are suitable for use relative to various types of exercise equipment, as well as different embodiments of any particular type of equipment. For purposes of discussion, the present invention is described with reference to two different types of exercise dumbbells, one of which is disclosed in U.S. patent application Ser. No. 09/300,546, and the other of which is disclosed in U.S. patent application Ser. Nos. 08/939,845 and 09/246,825 (all of which name the same inventive entity and are commonly owned together with this application). The first disclosed embodiment of the present invention is also applicable to the dumbbell disclosed in U.S. Pat. No. 5,839,997 to Roth et al. All of these applications and patents are incorporated herein by reference.

Figure 1:
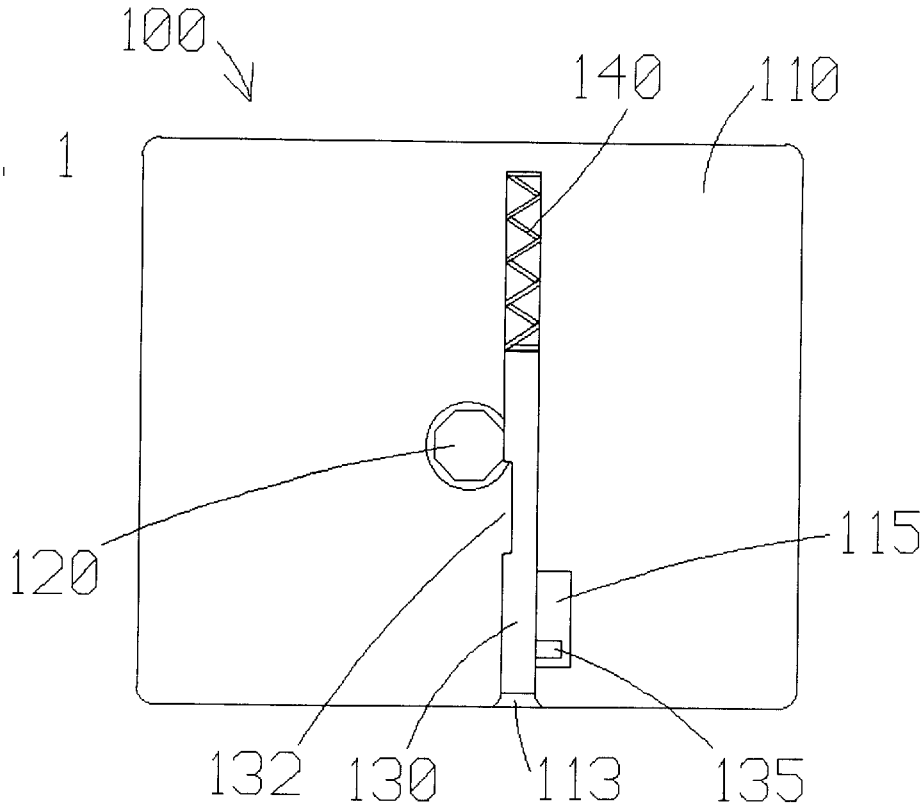
FIG. 1 is a sectioned end view of a selector rod locking assembly constructed according to the principles of the present invention.
Figure 2:
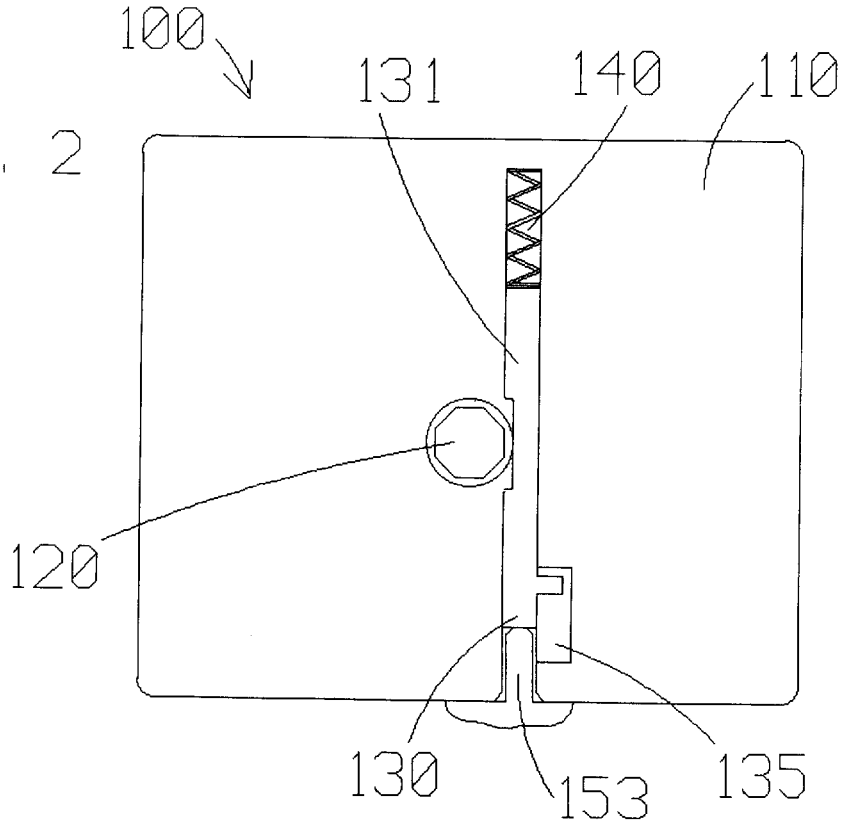
FIG. 2 is a sectioned side view of the locking assembly of FIG. 1 resting on top of a weight plate cradle.
Figure 3:
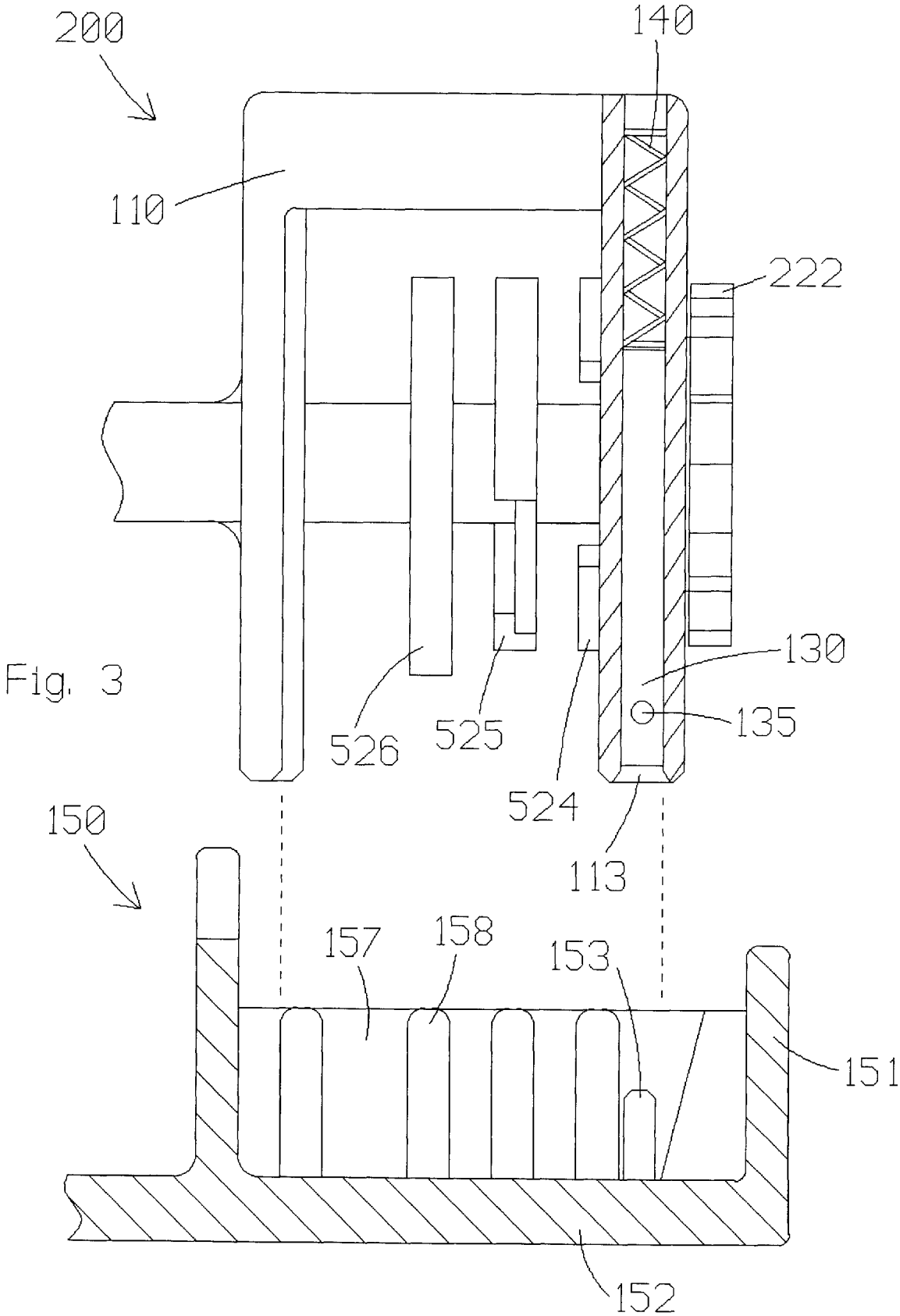
FIG. 3 is a partially sectioned side view of an adjustable weight dumbbell assembly provided with the locking assembly of FIG. 1 and disposed above a weight plate cradle.

A first embodiment of the present invention is designated as 100 in FIGS. 1–2, and is incorporated into the dumbbell assembly designated as 200 in FIG. 3. The dumbbell assembly 200 includes a handle 112 which is a cylindrical tube having a longitudinal axis. Respective housings 110 are secured to opposite ends of the handle 112 by welding or other suitable means. Each housing 110 includes an inside end wall, an outside end wall, a top wall, and opposite side walls, which cooperate to define a downwardly opening compartment. Spacers may be provided to extend downward from the top wall and occupy axial spaces between adjacent weights which fit inside the housing 110.

A selector rod 120 is rotatably mounted relative to both the handle 112 and the housings 110. The selector rod 120 includes a shaft and two sets of weight engaging members or supports 524–526 mounted on the shaft. Each of the weight supports 524–526 includes an axially extending hub, a radially extending rim, and an axially extending lip. Each support 524–526 is a single piece of integrally molded plastic, and each rim may be said to be integrally interconnected between the lip and the hub. An opening, sized and configured to receive an end of the selector rod 120, extends through the hub and the rim. The lips on the supports 524–526 have discrete segments which cooperate to retain a respective weight as a function of selector rod orientation. A knob 222 is rigidly secured to an end of the selector rod 120 and is operable to rotate both the selector rod 120 and the supports 524–526 relative to the housings 110 and the handle 112.

Figure 5:
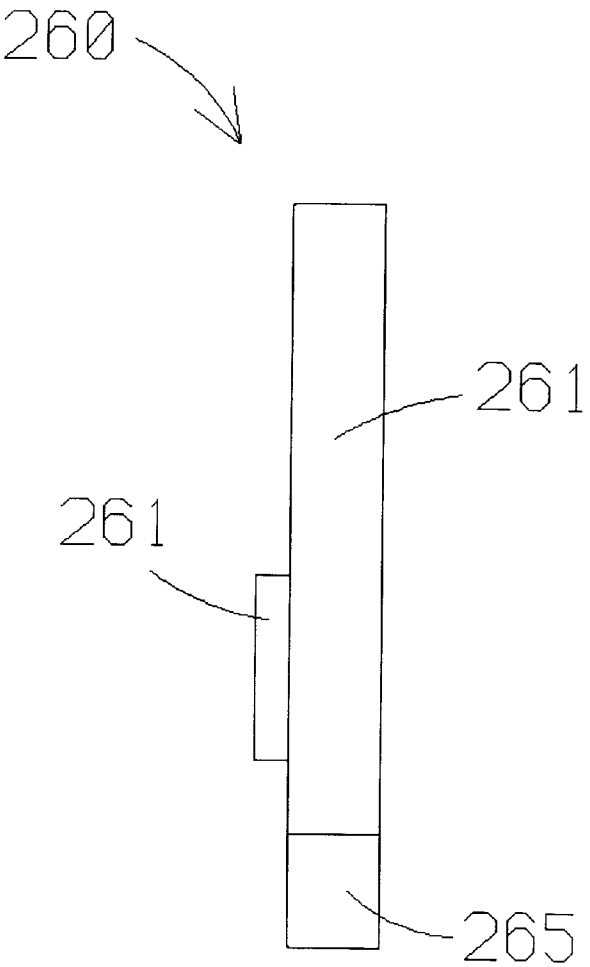
FIG. 5 is a side view of the weight plate of FIG. 4.
Figure 4:
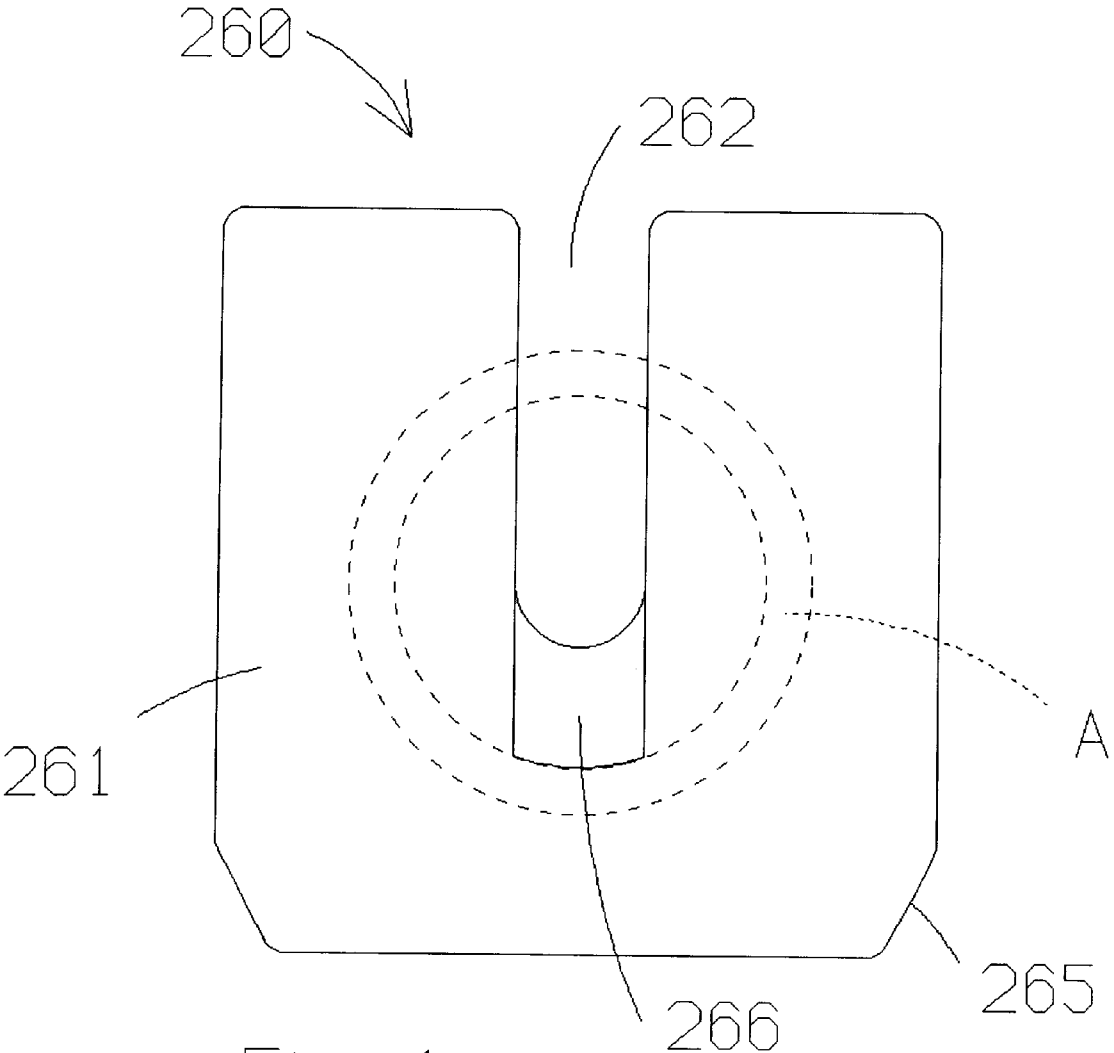
FIG. 4 is an end view of a weight plate suitable for use with the dumbbell assembly of FIG. 3.

One of the weights, which is representative of the other weights, is designated as 260 in FIGS. 4–5. The weight 260 is a generally square plate 261 having chamfered lower corners 265 and an elongate slot 262 extending inward from an upper edge thereof. The slot 262 is sized and configured to accommodate the axial hub of a respective weight support 524–526. Immediately beneath the slot 262, a peg 266 projects axially outward from the plate 261. The peg 266 is disposed just inside the path A traveled by the axially extending lip on a respective weight support 524–526. When a segment of the lip is disposed beneath the peg 266, the weight 260 is constrained to move upward together with the handle 112.

The lips on the weight supports 524–526 are configured and arranged so that any and all combinations of three different weights may be selected. Thus, the supports 524–526 are designed for rotation in 45° increments, and a ball detent or other known biasing system may be interconnected between the housing 110 and either the knob 222 or the selector rod 120, for example, to bias the selector rod 120 toward the desired orientations. The lips on the weight supports 524–526 are configured to provide clearance or tolerance vis-a-vis the pegs 266, such that when any given weight is not engaged, the respective lip is at least 6.5° outside the boundary of the peg 266.

Any "unselected" weights remain on a base or cradle designated as 150 in FIG. 3. The cradle 150 includes end walls 151 extending upward from opposite ends of a bottom wall 152. A single post 153 extends upward from the bottom wall 152, proximate one end of the cradle 150, for reasons described below. Opposing side walls 157 extend upward from opposite sides of the bottom wall 152, and spacers 158 project inward from the side walls 157 and define gaps sized and configured to receive respective weights. Gaps are also provided between the end spacers 158 and the walls of the cradle to accommodate the end walls of the housing 110.

A latch or locking pin 130 is movably mounted within a bore 113 formed in the inside end wall of the housing 110 and functions to prevent rotation of the selector rod 120 except when the assembly 200 is resting on the cradle 150. A helical spring 140 is compressed between an upper end of the bore 113 and an upper end of the pin 130 to bias the pin 130 downward into the position shown in FIG. 1. A nub 135 projects radially outward from the pin 130 and into an adjacent slot 115 formed in the inside end wall of the housing 110, thereby limiting downward movement of the pin 130 relative to the housing 110. When the pin 130 is subjected only to the force of the spring 140, it occupies the position shown in FIG. 1, and a bearing surface 131 on the pin 130 occupies a position immediately adjacent a flat surface on the selector rod 120. In this configuration, the selector rod 120 is locked against rotation relative to the housing 110.

When the dumbbell assembly 200 is properly positioned in a docked or resting position on the cradle 150, the post 153 on the cradle 150 projects into the bore 113 in the housing 110 and pushes upward against the bottom of the pin 130 (which may be described as a button that is accessible via the opening 113), against the spring 140. The lower end of the bore 113 is chamfered to help guide the post 153 into the bore 113. When the pin 130 is forced upward into the position shown in FIG. 2, a recess or notch 132 in the pin 130 aligns with the selector rod 120 and provides clearance for rotation of the selector rod 120 relative to the housing 110. As a result of this arrangement, the selector rod 120 is rotatable relative to the housing 110 only when the dumbbell assembly 200 is resting on the cradle 150, and thus, any engaged weights cannot be inadvertently disengaged during exercise activity.

Figure 6:
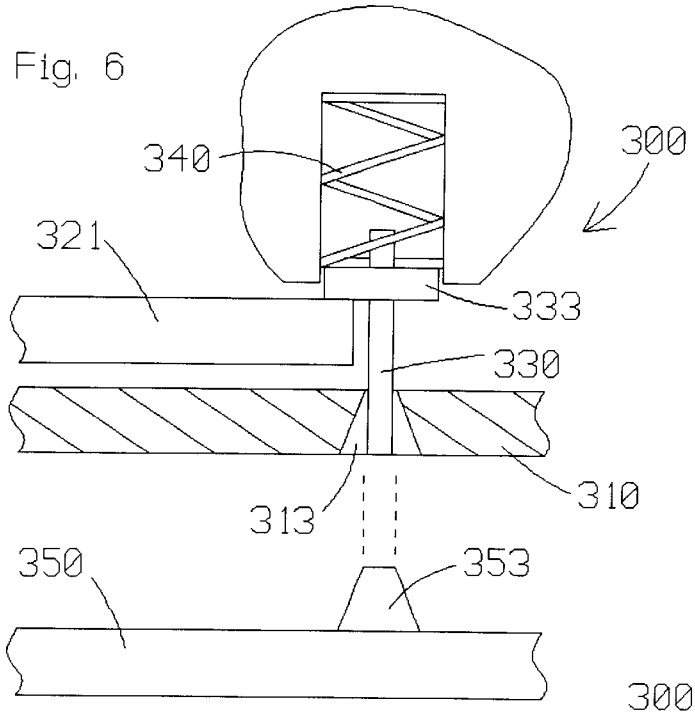
FIG. 6 is a sectioned side view of another selector rod locking assembly constructed according to the principles of the present invention and disposed above a weight plate cradle.
Figure 7:
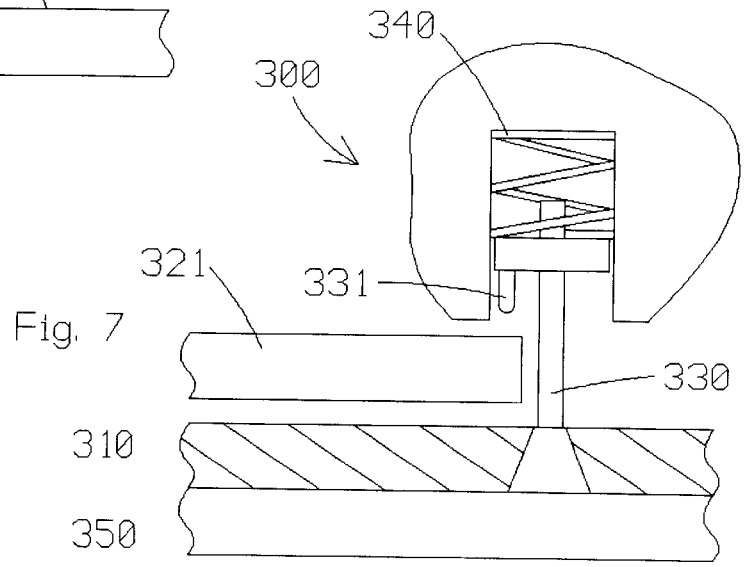
FIG. 7 is a sectioned side view of the locking assembly of FIG. 6 resting on top of a weight plate cradle.
Figure 8:
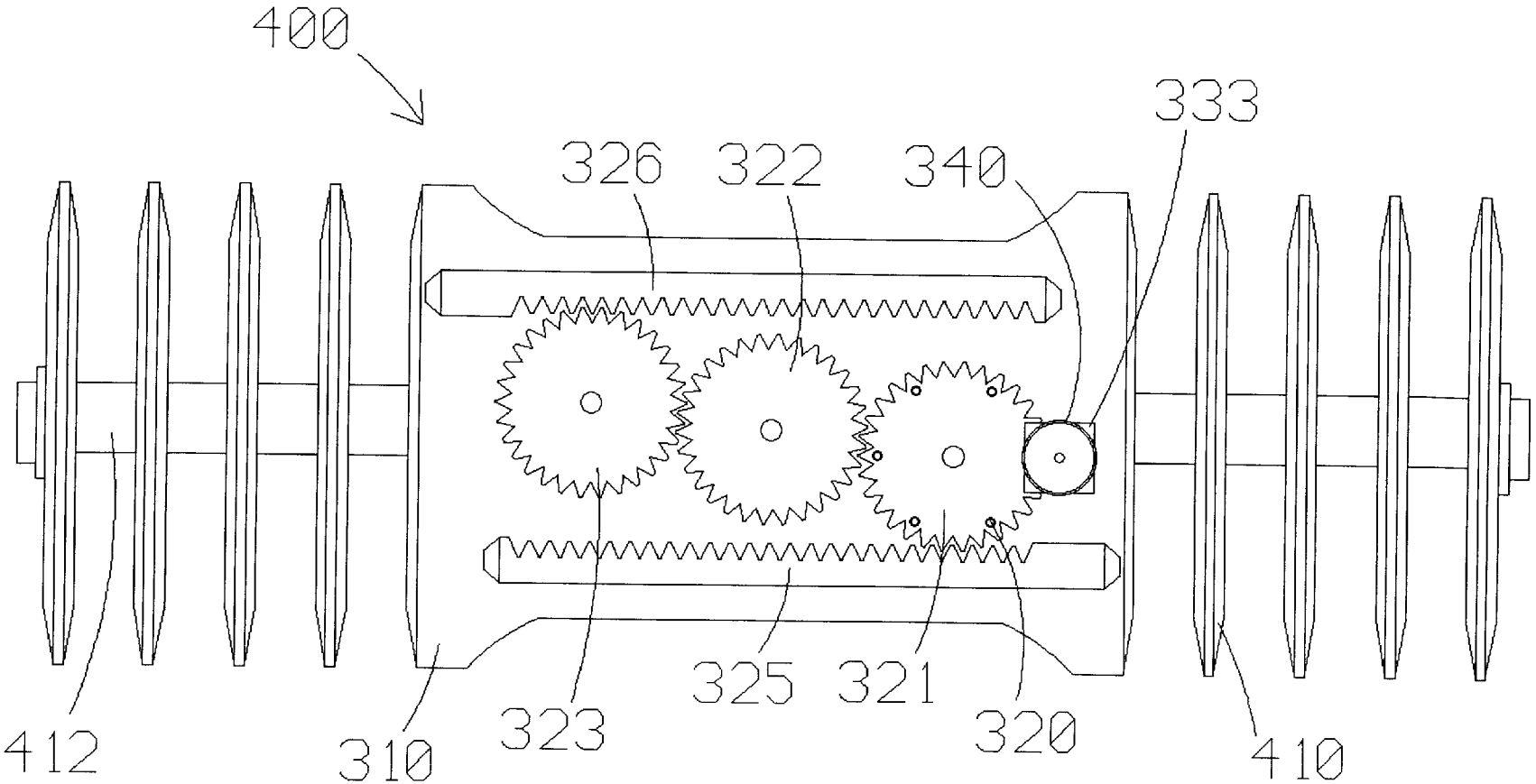
FIG. 8 is a partially sectioned top view of an adjustable weight dumbbell assembly provided with the locking assembly of FIG. 6.

A second embodiment of the present invention is designated as 300 in FIGS. 6–7, and is incorporated into the dumbbell assembly designated as 400 in FIG. 8. The dumbbell assembly 400 includes a handle bar (not shown) which is cylindrical and has a longitudinal axis. Spacers 410 are fitted onto opposite ends of the handle bar and maintained in place by axially extending hubs 412 which are keyed to the handle and secured between respective ends of an intermediate selector assembly 310 and respective ends of the handle. An intermediate portion of the handle bar extends between opposite ends of the selector assembly 310 and is sized and configured for grasping.

Figure 9:
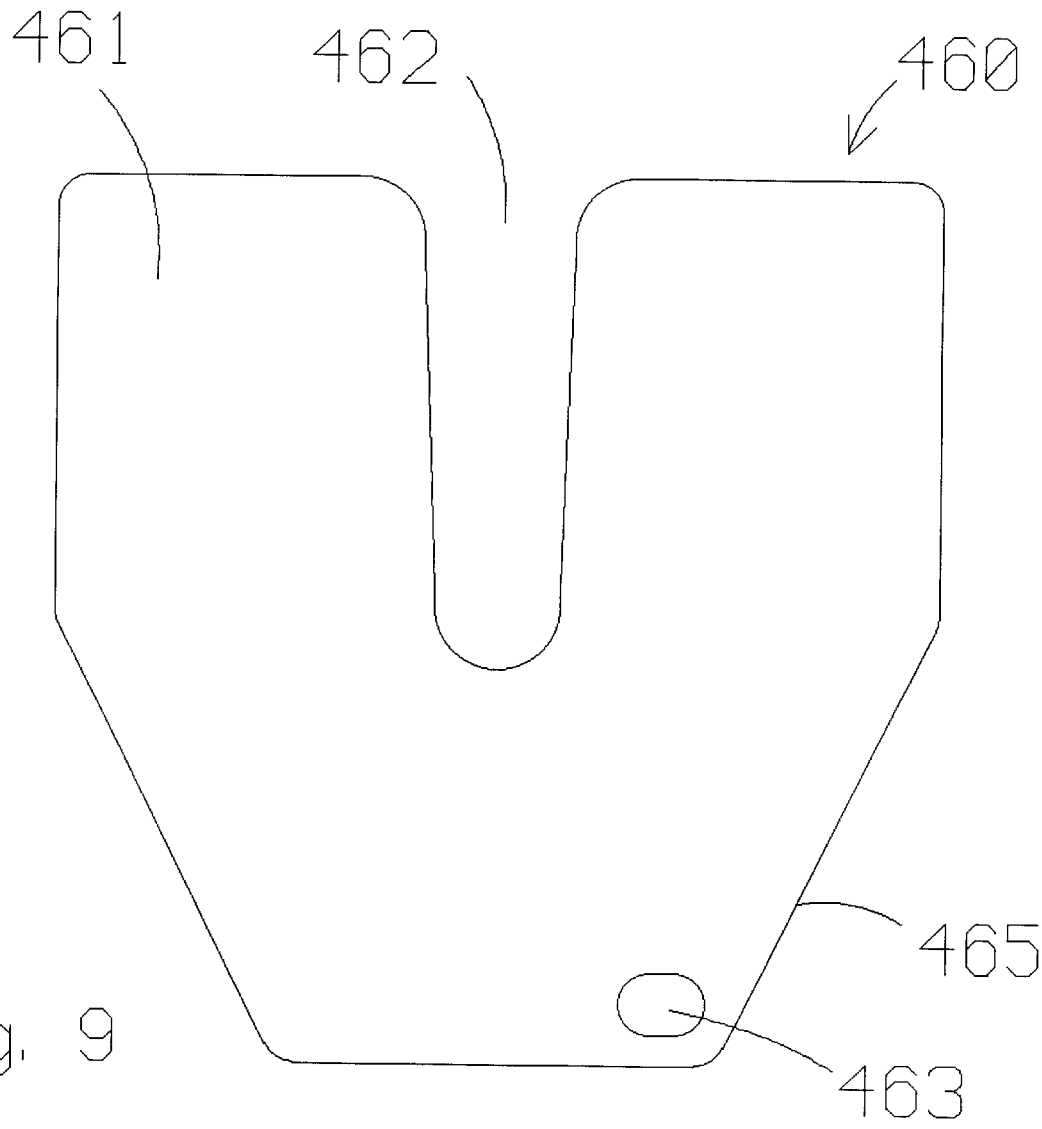
FIG. 9 is an end view of a weight plate suitable for use with the dumbbell assembly of FIG. 8.

FIG. 9 shows a weight 460 which is sized and configured to fit between adjacent spacers 410. The weight 460 is a generally square plate 461 having chamfered lower corners 465, and an elongate slot 462 which extends inward from the upper edge thereof. Also, for reasons discussed below, a hole 463 extends through a lower corner of the plate 461, and similar holes, positioned to align with the hole 463, extend through the spacers 410.

The selector assembly 310 spans the handle portion of the handle bar, and is preferably spaced as far below the handle portion as possible. As shown in FIG. 8, a middle gear 322 is rotatably mounted at the center of the selector assembly 310, and additional gears 321 and 323 are rotatably mounted at diametrically opposed positions relative to the central gear 322. Also, a selector rod 325 is disposed adjacent the gear 321 and has a rack of gear teeth which mate with the teeth on the gear 321 to link rotation of the gear 321 to linear movement of the rod 325. Similarly, a selector rod 326 is disposed adjacent the gear 323 and has a rack of gear teeth which mate with the teeth on the gear 323 to link rotation of the gear 323 to linear movement of the rod 326. The gears 321–323 and the selector rods 325–326 are arranged in such a manner that rotation of the gear 322 causes the selector rods 325–326 to move in opposite directions. The assembly may be operated by turning any of the gears 321–323 (via a knob, for example) or by sliding either of the rods 325–326 (via an exposed tab, for example).

As the selector rods 325–326 move outward from the selector assembly 310, they pass through holes 463 in respective weights 460 and aligned holes in respective spacers 410 to secure a desired number of weights 460 to the handle bar. As on the first embodiment, a detent arrangement may be provided between the housing for the selector assembly 310 and either of the rods 325–326 and/or any of the gears 321–323 to bias the rods 325–326 toward discrete positions. Also, a base or cradle is provided to retain any unselected weights, as well as the selector assembly 310 when not in use.

Circumferentially spaced holes 320, having chamfered sidewalls at their upper ends, are provided in the gear 321 and are rotatable into alignment with a latch or locking pin 331. The pin 331 projects downward from a nut 333 which is threaded onto an end of a bolt 330. The nut 333 is sized and configured for insertion into a cavity in the selector assembly 310. A helical spring 340 is compressed between the top wall of the cavity and the top of the nut 333, to bias the nut 333 downward into the position shown in FIG. 6. In this configuration, the pin 331 projects into one of the holes 320 and thereby locks the gear 321 (and the selector rod 325–326) in place. Also, the bolt 330 extends into a hole 313 in the bottom of the selector assembly 310 (and thereby provides a button for activating the selector assembly, as further explained below).

When the selector assembly 310 is aligned with the cradle 350 and the weights, and docked or set on top of the cradle 350, a peg 353 on the cradle 350 extends upward into the hole 313 and pushes the bolt 330 to the position shown in FIG. 7 (the sidewalls of the hole 313 are downwardly divergent to help guide the peg 353 into the hole 313). In this configuration, the pin 331 is disposed entirely above the gear 321, and the latter is free to rotate (thereby freeing the selector rods 325–326 for movement, as well) As a result of this arrangement, the selector rods 325–326 are movable relative to the selector assembly 310 only when the dumbbell assembly 400 is resting on the cradle 350, and thus, any engaged weights cannot be inadvertently disengaged during exercise activity.

Although the present invention has been described with reference to particular embodiments and specific applications, it is applicable in additional situations, as well. For example, certain weight machine applications are disclosed in at least one of the documents which is incorporated herein by reference. This disclosure is also likely to enable those skilled in the art to derive various other embodiments of and/or combinations of the present invention. For example, sliding selector rods may be used without interconnecting gears, in which case, longitudinally spaced notches in the rods may be provided to interact with latches along the lines of those shown in FIGS. 1–2. Moreover, the linearly sliding latch(es) may be replaced by pivoting latches for purposes of selectively latching the linearly sliding selector rod(s) in place. In this regard, a rod would be slidable only when the recessed portion of the latch was adjacent the rod (and not when the shoulder portion of the latch occupied a notch in the rod). In view of the foregoing, the scope of the present invention should not be limited only to the extent of the claims set forth below.

What is claimed is:

1. A method of selectively adjusting weight to be moved in connection with exercise activity, comprising the steps of:

providing a base;

providing weights;

positioning the weights on the base; and providing a weight selector assembly for movement to and from a rest position relative to the base, and operable to select a desired number of the weights only when occupying the rest position, wherein the weight selector assembly is provided with a button that is accessible via an opening, and with a weight selector member that is operatively connected to the button, and the base is provided with a member that engages the button when the weight selector assembly occupies the rest position, and gravitational force acting upon the weight selector assembly is sufficient to overcome a downward bias force acting upon the button, thereby moving the button upward relative to the weight selector assembly and freeing the weight selector member for movement to select the desired number of weights.

2. The method of claim 1, wherein a handle is provided together with the weight selector assembly to facilitate lifting of the weight selector assembly.

3. The method of claim 1, further comprising the steps of moving the weight selector assembly to the rest position, moving the weight selector member from a first position, wherein a first combination of the weights is secured to the weight selector assembly, and the button is aligned with a first bearing surface on the weight selector member, to a second position, wherein a second combination of the weights is secured to the weight selector assembly, and the button is aligned with a second bearing surface on the weight selector member, and then removing the weight selector assembly from the rest position to perform a weight lifting exercise.

4. The method of claim 3, further comprising the steps of again moving the weight selector assembly to the rest position, moving the weight selector member from the second position to a third position, wherein a third combination of the weights is secured to the weight selector assembly, and the button is aligned with a third bearing surface on the weight selector member, and then again removing the weight selector assembly from the rest position to perform a weight lifting exercise.

5. The method of claim 1, further comprising the steps of moving the weight selector assembly to the rest position, moving the weight selector member from a first position, wherein a first combination of the weights is secured to the weight selector assembly, and the button is aligned with a first opening in the weight selector member, to a second position, wherein a second combination of the weights is secured to the weight selector assembly, and the button is aligned with a second opening in the weight selector member, and then removing the weight selector assembly from the rest position to perform a weight lifting exercise.

6. The method of claim 5, further comprising the steps of again moving the weight selector assembly to the rest position, moving the weight selector member from the second position to a third position, wherein a third combination of the weights is secured to the weight selector assembly, and the button is aligned with a third opening in the weight selector member, and then again removing the weight selector assembly from the rest position to perform a weight lifting exercise.

7. A method of selectively adjusting weight to be moved in connection with exercise activity, comprising the steps of:

providing a base;

providing weights;

positioning the weights on the base; and providing a weight selector assembly for movement to and from a rest position relative to the base, and for operable to select a desired number of the weights only when occupying the rest position, wherein the weights are positioned in opposite first and second sets with a space defined therebetween to receive the weight selector assembly between the sets.

8. The method of claim 7, wherein a handle is provided together with the weight selector assembly to facilitate lifting of the weight selector assembly.

9. The method of claim 7, wherein the selector assembly is provided with a button which is accessible via an opening, and a selector member which is operatively connected to the button, and the base is provided with a member which engages the button when the weight selector assembly occupies the rest position, and gravitational force acting upon the weight selector assembly is sufficient to overcome a downward bias force acting upon the button, thereby moving the button upward relatively to the weight selector assembly, and freeing the selector member on the weight selector assembly for movement relative to the weights.

10. The method of claim 7, wherein the weight selector assembly is provided with a movable weight selector member, and a movable latch that interferes with operational movement of the weight selector member when the weight selector assembly is removed from the rest position, and further comprising the steps of moving the weight selector assembly to the rest position, moving the weight selector member from a first position, wherein a first combination of the weights is secured to the weight selector assembly, and the latch is aligned with a first bearing surface on the weight selector member, to a second position, wherein a second combination of the weights is secured to the weight selector assembly, and the latch Is aligned with a second bearing surface on the weight selector member, and then removing the weight selector assembly from the rest position to perform a weight lifting exercise.

11. The method of claim 10, further comprising the steps of again moving the weight selector assembly to the rest position, moving the weight selector member from the second position to a third position, wherein a third combination of the weights is secured to the weight selector assembly, and the latch is aligned with a third bearing surface on the weight selector member, and then again removing the weight selector assembly from the rest position to perform a weight lifting exercise.

12. The method of claim 7, wherein the weight selector assembly is provided with a movable weight selector member, and a movable latch that interferes with operational movement of the weight selector member when the weight selector assembly is removed from the rest position, and further comprising the steps of moving the weight selector assembly to the rest position, moving the weight selector member from a first position, wherein a first combination of the weights is secured to the weight selector assembly, and the latch is aligned with a first opening in the weight selector member, to a second position, wherein a second combination of the weights is secured to the weight selector assembly, and the latch is aligned with a second opening in the weight selector member, and then removing the weight selector assembly from the rest position to perform a weight lifting exercise.

13. The method of claim 12, further comprising the steps of again moving the weight selector assembly to the rest position, moving the weight selector member from the second position to a third position, wherein a third combination of the weights is secured to the weight selector assembly, and the latch is aligned with a third opening in the weight selector member, and then again removing the weight selector assembly from the rest position to perform a weight lifting exercise.

14. The method of claim 7, wherein the weight selector assembly is provided with a weight selector rod that has a longitudinal axis, and further comprising the steps of moving the weight selector assembly to the rest position, and moving the selector rod axially to adjust which of the weights are connected to the weight selector assembly.

15. The method of claim 14, wherein the weight selector assembly is provided with a latch that is biased toward a locked position that interferes with axial movement of the weight selector rod when the weight selector assembly is removed from the rest position, and further comprising the steps of removing the weight selector assembly from the rest position, and performing a weight lifting exercise with the weight selector rod locked against operational movement.

16. The method of claim 7, wherein the weight selector assembly is provided with a weight selector rod that has a longitudinal axis, and further comprising the steps of moving the weight selector assembly to the rest position, and rotating the selector rod about its longitudinal axis to adjust which of the weights are connected to the weight selector assembly.

17. The method of claim 16, wherein the weight selector assembly is provided with a latch that is biased toward a locked position that interferes with rotation of the weight selector rod when the weight selector assembly is removed from the rest position, and further comprising the steps of removing the weight selector assembly from the rest position, and performing a weight lifting exercise.

18. A method of selectively adjusting weight to be moved in connection with exercise activity, comprising the steps of:

providing a base;

providing weights;

positioning the weights relative to the base;

providing a selector assembly configured to selectively support the weights for exercise activity, and including (a) a movable selector member having a bearing surface, and (b) a latch having a recess that aligns with the bearing surface when the selector assembly occupies a docked position relative to the base and the weights, and a shoulder that is biased to engage the bearing surface upon removal of the selector assembly from the docked position;

moving the selector assembly into the docked position, whereby the recess on the latch aligns with the bearing surface on the selector member, thereby releasing the selector member for operational movement;

operating the selector member to secure desired weights to the selector assembly for removal from the base; and removing the selector assembly from the docked position, whereby the shoulder on the latch engages the bearing surface on the selector member, thereby automatically locking the selector member against operational movement.

19. The method of claim 18, wherein a handle is provided together with the weight selector assembly to facilitate lifting of the weight selector assembly, and the weights are positioned in first and second sets at opposite ends of the handle.

20. The method of claim 18, wherein the selector assembly is provided with a selector member having more than one said bearing surface, and the selector member is selectively moved to at least three different weight engaging positions, and in each of said positions a respective said bearing surface aligns with the latch.

21. The method of claim 18, wherein all of the steps are performed a first time to provide a first suitably weighted dumbbell, and all of the steps are performed a second time to provide a second suitably weighted dumbbell, and further comprising the steps of lifting each said dumbbell in a respective hand, and performing a weight lifting exercise.

22. A method of selectively adjusting weight to be moved in connection with exercise activity, comprising the steps of:

providing a base;

providing weights;

positioning the weights relative to the base;

providing a selector assembly configured to selectively support the weights for exercise activity, and including (a) a movable selector member having a hole formed therein, and (b) a latch having a peg that is biased to remain inside the hole when the selector assembly is removed from a docked position relative to the base and the weights, and that remains free of the hole when the selector assembly occupies the docked position;

moving the selector assembly into the docked position, whereby the peg on the latch vacates the hole in the selector member, thereby releasing the selector member for operational movement;

operating the selector member to adjust which said weights are connected to the selector assembly for removal from the base; and removing the selector assembly from the docked position, whereby the peg on the latch enters the hole in the selector member, thereby automatically locking the selector member against operational movement.

23. The method of claim 22, wherein the selector assembly is provided with a selector member having more than one said hole, and the selector member is selectively moved to at least three different weight engaging positions, and in each of said positions a respective said hole aligns with the latch.

24. The method of claim 22, wherein all of the steps are performed a first time to provide a first suitably weighted dumbbell, and all of the steps are performed a second time to provide a second suitably weighted dumbbell, and further comprising the steps of lifting each said dumbbell in a respective hand, and performing a weight lifting exercise.

25. The method of claim 22, wherein a handle is provided together with the weight selector assembly to facilitate lifting of the weight selector assembly, and the weights are positioned in first and second sets at opposite ends of the handle.

26. An exercise apparatus, comprising:

a base;

weights supported by the base;

a selector assembly movable into alignment with the base, wherein the selector assembly includes a selector rod that is selectively rotatable into engagement with desired weights; and a means for preventing rotation of the selector rod relative to the desired weights when the selector assembly is removed from the base, wherein the means includes a latch having a shoulder and a recess which are alternatively movable into a position adjacent the rod.

27. The exercise apparatus of claim 26, wherein the means further includes a spring which biases the latch toward a latched position, wherein the shoulder is adjacent the rod.

28. The exercise apparatus of claim 27, wherein a member extends from the base and engages the latch when the selector assembly is resting on the base, and the member cooperates with gravity acting upon the selector assembly to push the latch to an unlatched position, wherein the recess is adjacent the rod.

29. The exercise apparatus of claim 26, wherein the selector rod has a first bearing surface that aligns with the latch when the selector rod is rotated into engagement with a first combination of weights, and a second bearing surface that aligns with the latch when the selector rod is rotated into engagement with a second combination of weights, and a third bearing surface that aligns with the latch when the selector rod is rotated into engagement with a third combination of weights.

30. The exercise apparatus of claim 26, wherein a handle is secured to the weight selector assembly to facilitate lifting of the weight selector assembly, and the weights are arranged in first and second sets at opposite ends of the handle.

31. An exercise apparatus, comprising:

a base;

weights supported by the base;

a selector assembly movable into alignment with the base, wherein the selector assembly includes a selector rod that is selectively slidable into engagement with desired weights; and a means for preventing sliding of the selector rod relative to the desired weights when the selector assembly is removed from the base, wherein the means includes a spring-biased latch which is biased toward a latched position, wherein the latch interferes with sliding of the rod.

32. The exercise apparatus of claim 31, wherein a member extends from the base and engages the latch when the selector assembly is resting on the base, and the member cooperates with gravity acting upon the selector assembly to push the latch out of the latched position.

33. The exercise apparatus of claim 32, wherein the rod is linked to a gear rotatably mounted on the selector assembly, and the latch is provided with a peg which extends into a hole in the gear when the latch occupies the latched position.

34. The exercise apparatus of claim 31, wherein a handle is secured to the weight selector assembly to facilitate lifting of the weight selector assembly, and the weights are arranged in first and second sets at opposite ends of the handle.

35. The exercise apparatus of claim 31, wherein the selector rod defines a longitudinal axis, and the selector rod is selectively movable into at least three different, axially spaced, weight engaging positions.

36. An exercise dumbbell, comprising:

a plurality of weights;

a handle assembly including a handle, a selector member that is movable relative to the handle to secure desired weights to the handle assembly, and a latch that is biased toward a locked position that blocks operation of the selector member; and a base configured to support the weights in first and second sets with a space defined therebetween to accommodate the handle, wherein an upwardly extending member on the base cooperates with gravity acting upon the handle assembly to move the latch out of its locked position when the handle assembly occupies a rest position on the base, thereby releasing the selector member for movement relative to the handle.

37. The exercise apparatus of claim 36, wherein the selector member is movable from a first position, wherein a first combination of the weights is secured to the handle assembly, and a first bearing surface on the selector member aligns with the latch, and a second position, wherein a second combination of the weights is secured to the handle assembly, and a second bearing surface on the selector member aligns with the latch, and a third position, wherein a third combination of the weights is secured to the handle assembly, and a third bearing surface on the selector member aligns with the latch.

38. The exercise apparatus of claim 36, wherein the selector member is movable from a first position, wherein a first combination of the weights is secured to the handle assembly, and a first opening in the selector member aligns with the latch, and a second position, wherein a second combination of the weights is secured to the handle assembly, and a second opening in the selector member aligns with the latch, and a third position, wherein a third combination of the weights is secured to the handle assembly, and a third opening in the selector member aligns with the latch.

39. The exercise apparatus of claim 36, wherein the selector member is rotatable relative to the handle to at least three different weight engaging orientations, and the selector member is configured to be selectively locked in place by the latch in each of the orientations.

* * * * *